United States Patent [19]

Neuman et al.

[11] Patent Number: 4,558,482

[45] Date of Patent: Dec. 17, 1985

[54] TYPE ELEMENT CLEANER

[75] Inventors: Eli Neuman, Tarzana; Lew Whitaker, Pacific Palisades, both of Calif.

[73] Assignee: Perfectdata, Chatsworth, Calif.

[21] Appl. No.: 644,138

[22] Filed: Aug. 23, 1984

Related U.S. Application Data

[63] Continuation of Ser. No. 411,330, Aug. 25, 1982, abandoned.

[51] Int. Cl.[4] ..... B41F 35/00

[52] U.S. Cl. ..... 15/97 R; 15/104.92; 15/210 R; 400/701

[58] Field of Search ..... 15/104.92, 104.93, 97 R, 15/21 A, 21 B, 104 R, 160 R, 210 R; 400/702, 701

[56] References Cited

U.S. PATENT DOCUMENTS

| | | | |
|---|---|---|---|
| 1,683,458 | 9/1928 | Hall | 15/21 A |
| 3,583,016 | 6/1971 | McConnell | 15/97 R |
| 4,017,933 | 4/1977 | Aja | 15/21 A |
| 4,171,167 | 10/1979 | Swartwout | 15/21 A |

*Primary Examiner*—Edward L. Roberts

*Attorney, Agent, or Firm*—Spensley Horn Jubas & Lubitz

[57] ABSTRACT

A moistened fabric pad is supported in a container having a cover configured to engage a type element. The cover is fastened to the container so that the fabric pad and type element are brought into contact. Rotation of the type element against the surface of the moistened fabric pad removes dirt and ink from all areas of the type element.

10 Claims, 4 Drawing Figures

TYPE ELEMENT CLEANER

CROSS REFERENCE TO RELATED APPLICATION

This is a Continuation of application Ser. No. 06/411,330 filed Aug. 25, 1982 and now abandoned.

BACKGROUND OF THE INVENTION

1. Field of the Invention

The present invention relates to a type element cleaner and more particularly to a type element cleaner for removable type elements used on information processing printers and office typewriters.

2. Description of the Prior Art

Type elements require periodic cleaning to insure that the print characters produce consistently sharp and clear impressions. This is true whether the type element is a typewriter slug, selectric ball, thimble or daisy wheel.

Traditionally these type elements have been cleaned manually by means of a cleaning putty or the like. This method of cleaning is extremely messy and inconvenient. In an attempt to simplify the cleaning procedure, systems have been introduced in which the type element is first immersed in a solvent or detergent bath, and dirt and ink is then removed by means of a brush or sponge. Such prior art type element cleaners are illustrated in U.S. Pat. No. 4,017,933 to Aja et al. and U.S. Pat. No. 4,171,167 to Swartout, both of which disclose methods for cleaning selectric ball type elements by immersion in a solvent or detergent bath. Because of their use of a solvent bath, these prior art cleaning systems are inconvenient, messy and very inefficient. As a result type elements are not cleaned as often as they should be.

An objective of the present invention is to provide a simple, inexpensive and practical way to clean the type elements available on most of today's information processing printers and typewriters.

A further objective of the present invention is to provide a type element cleaner which does not require the type element to be submerged in a bath of cleaning fluid.

SUMMARY OF THE INVENTION

In accordance with the present invention, these and other objectives are achieved by providing a container which supports a fabric pad. A cover configured to engage a type element is attached to the container by means of a hinge.

In operation the pad is wetted with a cleaning solution. The cover is closed and the fabric pad and type element are brought into contact. Rotation of the type element against the surface of the moistened fabric pad removes dirt and ink from all areas of the type element.

BRIEF DESCRIPTION OF THE DRAWINGS

A detailed description of the invention will be made with reference to the accompanying drawings, wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
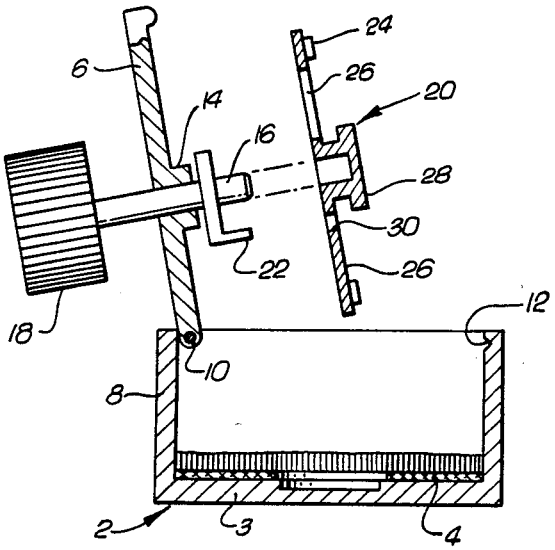
FIG. 1 is a side section view of one embodiment of the present invention in the cover open position.
Figure 2:
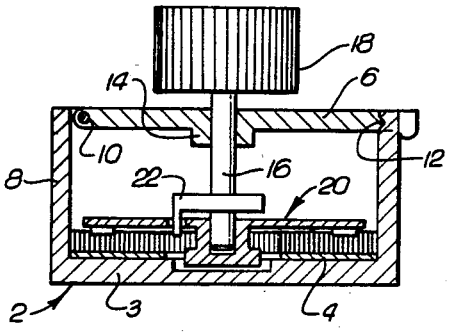
FIG. 2 is a side section view of the embodiment shown in FIG. 1 in the cover closed position.

Referring to FIGS. 1 and 2, the type element cleaner consists of a container 2. In the embodiment shown the container 2 comprises a rectangular plastic box.

A fabric pad 4 rests on the bottom 3 of the container 2. In the preferred embodiment the fabric pad 4 is composed of white material so that contamination of the pad 4 by dirt and ink may be determined by visual inspection.

A cover 6 is attached to one wall, 8 of the container 2 by means of a hinge 10. The hinge 10 allows movement of the cover 6 from an open position illustrated in FIG. 1 to a closed position illustrated in FIG. 2. In the closed position, the cover 6 may be securely fastened to the container 2 by means of a fastener 12 such as a snap-lock or the like.

The cover 6 further contains an annular collar 14 which encloses a rotatable cylindrical shaft 16 that projects both above and below the plane defined by the cover 6 and which is capable of freely rotating in either direction. A knurled knob 18 is connected to the top of the shaft 16 in order to facilitate manual rotation of the shaft. It is recognized that shaft 16 might also be rotated by non-manual means, i.e., a motor may be incorporated into the present invention to facilitate powered rotation of the shaft 16.

The bottom of the shaft 16 is configured to engage a type element 20. In the embodiment shown in FIGS. 1 and 2, this type element 20 is of the variety commonly known as a daisy wheel, in which individual character faces 24 are positioned in a circle at the perimeter of the element 20 and are connected to an element hub 28 by means of radial support legs 26. Attached to the bottom of the shaft 16 is a driver 22 which engages a driver hole 30 located on the type element 20 and thereby enables rotation of the type element 20 in conjunction with rotation of the shaft 16.

To clean the type element 20, the pad 4 is first moistened with a cleaning solvent. Various liquids can be used for this purpose, including detergent, soap, volatile fluorocarbon, alcohol or other solvents. It has been found that a combination of volatile fluorocarbon and alcohol provides excellent cleaning results, while at the same time being fire retardant and therefore safe to handle.

The best cleaning results are achieved when the pad 4 is merely dampened with solvent. The pad 4 does not have to be saturated. In the embodiment of the invention shown in FIGS. 1 and 2, approximately two ml. of solvent are sufficient for this purpose.

In the preferred embodiment the solvent is stored in a plastic squeeze bottle (not shown). A few drops of the solvent may then be easily applied to the pad 4 prior to each cleaning. An important feature of the present invention is the elimination of an open reservoir of cleaning fluid which is found in prior art type element cleaners. The inherent problems of such a solvent reservoir, including spillage and noxious vapors, are totally eliminated by the present invention.

After the pad 4 has been moistened with cleaning solvent and the type element 20 has been affixed to the shaft 16 and the driver 22, the cover 6 is swung closed and secured to the container 2 by means of the fastener 12. The letter face 24 of the type element 20 and the surface of the pad 4 are thereby pressed into firm contact.

The knurled knob 18 is then rotated so that the type element 20 rotates with respect to the pad 4. The action of the moistened pad 4 against the type element 20 cleans the entire type element 20, including the support arms 26 as well as the letter face 24. Best results are achieved by rotating the shaft 16 in alternating clockwise and counter-clockwise directions.

At completion of the cleaning cycle, the cover 6 is raised and the type element 20 is removed. The clean type element 20 is then ready for immediate use.

The fabric pad 4 may be used repeatedly until it becomes contaminated with ink. When the fabric pad 4 appears dirty, it may be removed from the container 2 by inverting the container, whereupon the fabric pad 4 simply falls out of the container 2. There is no need to handle the contaminated fabric pad 4. A new fabric pad may then be placed into the container 2 for further cleaning operations.

Figure 3:
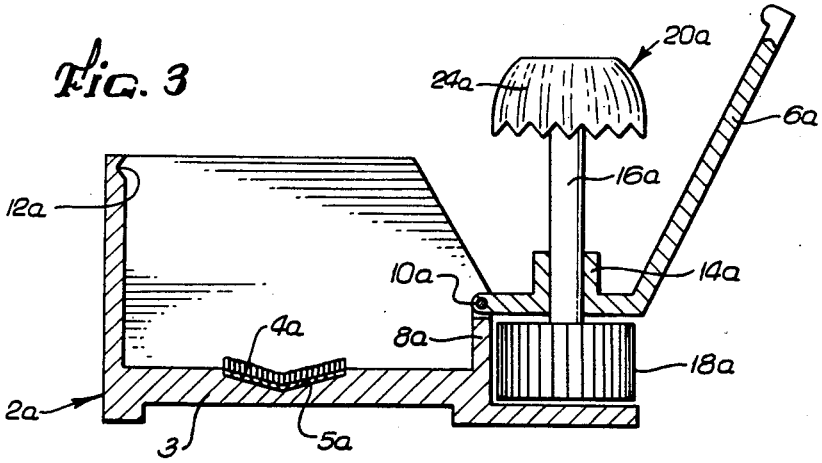
FIG. 3 is a side section view of another embodiment of the present invention in the cover open position.
Figure 4:
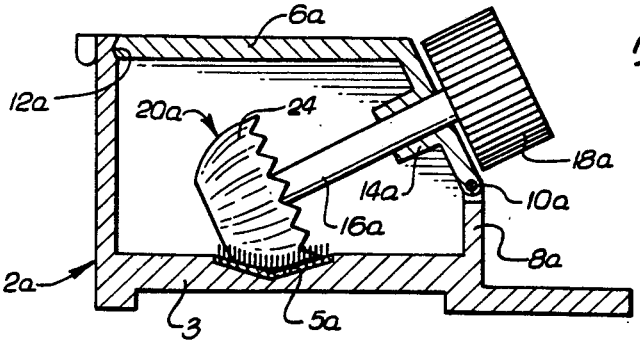
FIG. 4 is a side section view of the embodiment shown in FIG. 3 in the cover closed position.

FIGS. 3 and 4 illustrate an embodiment of the present invention specifically designed for the cleaning of selectric ball type elements. The container bottom 3 includes a concave indentation 5*a* which is shaped to conform to the curvature of a standard ball type element 20*a*. It is recognized that various other curvature-conforming shapes in addition to the configuration specifically illustrated in FIGS. 3 and 4 may be utilized for indentation 5*a*. A fabric pad 4*a*, composed of material identical to that described previously, is configured so that it rests, precisely within the confines of this indentation 5*a*.

A cover 6*a* is attached to one wall 8*a* of the container 2*a* by means of a hinge 10*a*. The hinge 10*a* allows movement of the cover 6*a* from an open position illustrated in FIG. 3 to a closed position illustrated in FIG. 4. In the closed position, the cover 6*a* may be securely fastened to the container 2*a* by means of a fastener 12*a* such as a snap-lock or the like.

The cover 6*a* further contains a collar 14*a* which encloses a rotatable cylindrical shaft 16*a*, which is capable of rotating both in a clockwise and counterclockwise direction. A knurled knob 18*a* is connected to the top of the shaft 16*a* in order to facilitate manual rotation of the shaft.

The bottom of the shaft 16*a* is configured to engage a selectric ball type element 20*a*.

To clean the type element 20*a*, the pad 4*a* is moistened with a cleaning solvent in the manner previously described. After the pad 4*a* has been moistened and the type element 20*a* has been affixed to the shaft 16*a*, the cover 6*a* is swung closed and secured to the container 2*a* by means of the fastener 12*a*. A portion of the letter face 24*a* of the type element 20*a* and the surface of the pad 4*a* are thereby pressed into contact.

The knurled knob 18*a* is then rotated so that the type element 20*a* rotates with respect to the pad 4*a*. The action of the moistened pad 4*a* against the type element 20*a* cleans the entire type element 20*a*.

As can be seen most clearly in FIG. 4, only a portion of the type element 20 is in contact with the pad 4*a* at any point in the rotation cycle of the shaft 16*a*. As the shaft 16*a* is rotated, any portion of the type element 20*a* will be moistened by its contact with the pad 4*a* and then allowed to dry during that portion of the rotation in which it is not in contact with the pad 4*a*. This repeated alternation between a wet period and a dry period has proven of added benefit in cleaning type elements of the selectric ball variety.

After completion of the cleaning cycle, the cover 6*a* is raised and the type element 20*a* is removed. The clean type element 20*a* is then ready for immediate use. The fabric pad 4*a* may be removed and replaced in the manner previously described.

The present invention may be embodied in other specific forms without departing from the spirit or essential characteristics thereof. For example, the type element 20 cleaned by the present invention may be of the kind known as a "thimble" element, such as presently produced by NEC, or a cartridge enclosed print wheel, such as presently produced by IBM or Brother. The fabric pad 4 may come in pre-soaked packet form, which could be used once and then discarded. A cleaning action identical to that produced by the present invention could be achieved by holding the type element 20 stationary and rotating the fabric pad with respect thereto.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A type element cleaner for a generally flat type element having a hub, a plurality of radial support arms, and a plurality of print characters respectively disposed on the support arms, the type element cleaner comprising:

a cleaning element having a generally planar cleaning surface;

a container having a generally flat bottom and a recessed portion centrally disposed at the bottom for receiving the type element hub, wherein the cleaning element is positioned on the bottom of the container; and a support shaft, rotatably connected to the container and oriented generally perpendicular to the container bottom, adapted to support the type element so that axial force on the shaft presses the type element against the cleaning element to cooperatively engage the type element print characters in a facing relationship with the cleaning element cleaning surface and rotation of the shaft provides relative movement between the type element and the cleaning element, wherein ink and contaminants are removed from the type element.

2. The type element cleaner of claim 1 wherein the support shaft is moveable with respect to the container in a direction along a longitudinal axis of the shaft.

3. The type element cleaner of claim 1 including a cleaning fluid applied to the cleaning element in an amount not greater than the amount necessary to saturate the cleaning element.

4. The type element cleaner of claim 1 wherein said cleaning element is removably disposed in said container.

5. The type element cleaner of claim 1 wherein said cleaning element is a fabric pad.

6. A type element cleaner for a generally spherical type element having print characters disposed about an exterior surface, said type element cleaner comprising:

a container having a bottom with a concave indentation shaped to substantially conform to the curvature of the type element;

a cleaning element mounted in said indentation and shaped to substantially conform to the curvature of the type element;

a cover pivotally connected to the container;

a support shaft rotatably coupled to the cover and adapted to support the type element so that closure of the cover causes axial force on the shaft to press a portion of the type element against the cleaning element so as to cooperatively engage a plurality of the type element print characters in a facing relationship with the cleaning element and rotation of the shaft provides relative movement between the type element and cleaning element, wherein ink and contaminants are removed from the type element.

7. The type element cleaner of claim 6 wherein the support shaft is movable with respect to the cover in a direction along a longitudinal axis of the shaft.

8. The type element cleaner of claim 6 including a cleaning fluid applied to the cleaning element in an amount not greater than the amount necessary to saturate the cleaning element.

9. The type element cleaner of claim 6 wherein said cleaning element is removably disposed in said container indentation.

10. The type element cleaner of claim 6 wherein said cleaning element is a fabric pad.

* * * * *